US007089825B2

(12) United States Patent
Klosterman

(10) Patent No.: US 7,089,825 B2
(45) Date of Patent: Aug. 15, 2006

(54) RING-TAB EXTENDING SLEEVE FOR EASY OPENING AND RE-CLOSING THE OPENING OF A BEVERAGE CONTAINER

(76) Inventor: Lawrence Gerald Klosterman, 36718 Thomas Dr., Sterling Heights, MI (US) 48312

( * ) Notice: Subject to any disclaimer, the term of this patent is extended or adjusted under 35 U.S.C. 154(b) by 0 days.

(21) Appl. No.: 10/878,736

(22) Filed: Jun. 28, 2004

(65) Prior Publication Data

US 2005/0284263 A1 Dec. 29, 2005

(51) Int. Cl.
*B67B 7/16* (2006.01)

(52) U.S. Cl. ..... 81/3.55; 81/3.35

(58) Field of Classification Search ..... 81/3.55, 81/3.15, 3.34, 3.27, 3.35; 7/151
See application file for complete search history.

(56) References Cited

U.S. PATENT DOCUMENTS

| | | | | |
|---|---|---|---|---|
| 4,253,352 | A * | 3/1981 | O'Neal | 81/3.55 |
| 4,254,646 | A * | 3/1981 | Selesnick | 69/30 |
| 4,442,950 | A | 4/1984 | Wilson | |
| 4,455,894 | A | 6/1984 | Roberts | |
| 4,463,866 | A | 8/1984 | Mandel | |
| 4,537,326 | A | 8/1985 | Morehead | |
| 4,602,723 | A | 7/1986 | DeMars | |
| 4,660,446 | A * | 4/1987 | Soltis | 81/3.55 |
| 4,673,099 | A | 6/1987 | Wells | |
| 4,681,238 | A | 7/1987 | Sanchez | |
| 4,717,039 | A | 1/1988 | Ayyoubi | |
| 4,720,022 | A | 1/1988 | Gomes | |
| 4,846,024 | A | 7/1989 | Bryant et al. | |
| 4,864,898 | A | 9/1989 | Tricinella | |
| 4,873,896 | A | 10/1989 | Hull | |
| 4,901,877 | A | 2/1990 | Hall | |
| 4,913,304 | A | 4/1990 | Corey | |
| 4,917,258 | A | 4/1990 | Boyd et al. | |
| 4,951,835 | A | 8/1990 | DeMars et al. | |
| 4,967,622 | A | 11/1990 | Phillips | |
| 4,979,635 | A | 12/1990 | Levine | |
| 5,080,249 | A | 1/1992 | Shock | |
| 5,110,002 | A | 5/1992 | Tucker | |
| 5,165,579 | A | 11/1992 | Lund | |
| 5,203,467 | A | 4/1993 | Tucker | |
| 5,240,132 | A | 8/1993 | Tucker | |
| 5,402,904 | A | 4/1995 | Close | |
| 5,497,896 | A | 3/1996 | Shand | |
| 5,509,380 | A | 4/1996 | Tipp | |
| 5,621,936 | A | 4/1997 | Penaligon et al. | |
| 5,911,794 | A * | 6/1999 | Nordhoff | 81/3.55 |
| 6,059,137 | A | 5/2000 | Westwood et al. | |
| 6,098,830 | A | 8/2000 | Jamieson | |

* cited by examiner

*Primary Examiner*—Lee D. Wilson
(74) *Attorney, Agent, or Firm*—VanOphem & VanOphem, P.C.

(57) ABSTRACT

A tab extending sleeve for a flip-top beverage, snack, and pet food container for easy opening and re-closing, wherein the sleeve is a substantially longitudinal member having a length, a width, a front end, and a distal end. The sleeve includes a top surface and a planar bottom surface being connected to each other, and an internal longitudinal channel is disposed between the top and bottom surfaces. The internal channel extends throughout the entire length of the tab extending sleeve with a width that adequately accommodates a lifting tab of the container. At the front end of the bottom surface there is provided a central notch, whereas an extended holding lip is disposed at the center of the distal end of the top surface which extends beyond the peripheral rim for easy lifting thereof of the beverage container.

11 Claims, 2 Drawing Sheets

RING-TAB EXTENDING SLEEVE FOR EASY OPENING AND RE-CLOSING THE OPENING OF A BEVERAGE CONTAINER

CROSS REFERENCE TO RELATED APPLICATION

Not Applicable

FEDERALLY SPONSORED RESEARCH OR DEVELOPMENT

Not Applicable

REFERENCE TO MICROFICHE APPENDIX

Not Applicable

BACKGROUND OF THE INVENTION

1. Field of the Invention

The present invention generally relates to a tool for use with a conventional beverage can having a lid pre-scored opening flap for easy opening by the use of an opening tab pivotally attached to the center of the lid using a rivet post. In particular, the invention relates to a tool adapted to mount on the ring-tab to facilitate the effective opening of the can and thereafter provide a convenient means for covering the opening to prevent insects and foreign matter from entering the beverage can.

2. Description of Related Art

Flip-top beverage containers or cans have been in use for a long time in the beverage industry alongside the widespread use of bottles. However, in recent times, the use of cans has become extremely pervasive, not only in beverage industries, but also in snack and pet food industries. The substantial increase of the use of cans in the respective industries, resulted in gradual modifications in the lid and lift tab portions of the can in order to facilitate the opening of the can by the user. In general, the lid of a beverage can consists of an opening tab pivotally attached approximately at the center of the lid with a rivet pin. The lid also includes a pre-scored flap portion disposed adjacent to the rivet and in between the rivet pin and the inner periphery of the upper rim of the can. The pivotally connected opening tab includes a lifting and gripping portion on one side of the rivet and a detent portion on the opposite end portion of the opening tab. The tab, when lifted upward, uses the rivet as a fulcrum to exert a mechanical lever action to depress the detent portion of the tab upon the scored flap portion in the lid so as to force the scored flap portion in the lid downwardly into the can to make an opening to enable dispensing the liquid from the can.

Although, such containers have been extremely popular in the beverage industries, nonetheless, they still inherently contain longstanding drawbacks that many inventors have repeatedly attempted to solve. Often, in lifting, the tab poses a challenge to physically challenged individuals with either physical disabilities in their hands or having long and/or brittle fingernails. Some extremely tightly manufactured tabs also may pose a problem to a perfectly average individual without any disabilities because of the difficulties incurred in attempting to grab the tab for lifting of same. Since the opening tabs are not insured against breakage from its pivotal connection with the rivet pin, they sometimes break off before the detent portion of the tab depresses the pre-scored flap portion of the lid in an attempt to open the can. This situation is often faced by waiters/waitresses under extremely busy time constraints, such as, when they need to open a can quickly, and invariably the tab breaks off the lid without making the intended opening to enable dispensing the liquid from the container. In addition, since the opening tab is incorporated only to facilitate the opening of the can, once open, the can is not re-sealable, and leaves a wide opening for various unintended foreign objects and small insects to gain access and contaminate the contents of the can. It is very common for bees, ants, and other insects to enter through the opening if the lid of the can is not properly covered. This is especially a problem when people open the can out of doors, i.e., during outdoor sporting events or a picnic. It is known that insects are also attracted by the sugar of the contents even in enclosed areas, such as bars and restaurants.

In the past, various inventors have made efforts to address the previously mentioned problems, and attempted solutions have been made in the field. Except for a few, most of the inventions require structural modifications of the lid itself in order to accommodate the improvements, necessitating a change in the manufacturing process of the can to incorporate a lid that is re-closable after it is opened. The present attempt to solve the aforesaid problems deal with using existing conventional containers without modifications of the lid itself. The following discussed prior art is limited to inventions which have attempted to improve the use of conventional containers, in which an improved opening of the can and an effective re-closing the same have been attempted.

The use of a separate device or means, removably attached to the opening tab of a container to manipulate the same, is well known in the beverage industry. Detailed delineation of typical approaches to using such devices in manipulating a lid of a container may be found in a number of U.S. patents. One of such teaches using a separate tab extension sleeve as described in U.S. Pat. No. 6,098,830 to Jamieson. In the Jamieson disclosure, two of the three embodiments of the invention have been directed to an improved lid, which requires a completely new process of manufacturing of the lid rather than using a conventional container lid. In these embodiments, the patent teaches a tab having an extended lifting section that overhangs and locks onto the rim of the container. The tab also includes a contoured sealing section integral with the extended lifting section. The contoured sealing section preferably includes a stamped ridge, which seats against the perimeter of the scored opening of the lid to seal the opening. The third embodiment of the invention illustrated in FIG. 10, on the other hand, calls for a separate tab extension sleeve, which may be used in conjunction with a conventional container lid. The sleeve includes two locking arms contoured to fit over the edges of a tab of a conventional container lid. The sleeve, according to the invention, has an extended lifting section, a locking section, and a contoured sealing section having a stamped ridge as provided in the first two embodiments. The operation of the device is described as follows. The sleeve is slipped over the tab to hold it steadily to open the can. To seal the can, the extended lifting section is used to rotate the tab 180 degrees, and place the sleeve over the opening, so that the contoured sealing section fits over the opening. Finally, the invention discusses that, the locking section of the tab snaps onto the rim of the can to lock the sleeve on the can. Although the invention attempts to provide a tab extension sleeve, which may be used to re-close an open can, nonetheless, it suffers from similar drawbacks that its predecessors failed to address. The perimeters of the opening flaps are different for different cans so it is not clear how the stamped ridge 32 can seal different size openings or different shape openings. The attempt to effectively close such openings with a tab extension sleeve, having pre-defined stamped ridges of the contoured sealing section, is ineffective in a sense that, the same ridges may not conform to the perimeters of every kind of opening flap in the lid. In addition, since the disclosure does not reveal as to how the sleeve's contoured sealing section mates against the perimeters of the opening flap, it is not clear whether the ridges of the sealing section are capable of being disposed completely inside the opening. In the event the ridges rest on the top of the lid, there must remain a gap between the bottom surface of the sleeve and the top surface of the lid, such that foreign objects and insects can enter the opening and contaminate the content of the can. Further, the disclosure teaches that the locking section snaps over the rim of the can to lock the sleeve in place. Since different can manufacturers have rims of different heights, it is not clear how snapping the locking section over the rim can possibly seal the opening if the rim heights will not allow the locking section to travel downwards sufficiently to seal the opening in the lid.

Another attempt to provide a device to re-close an open container is disclosed in U.S. Pat. No. 5,911,794 to Nordhoff. The reference teaches a method and a tool for manipulating an opening tab mounted on a beverage container. The tool 10, shown in FIG. 3 with the "prior art" legend has an elongated body 11 having a longitudinal length with a front end 18, a top face 12, and a lower face 14. An internal channel 60 is defined within a portion of the elongated body beginning in the front end and extending lengthwise within the elongated body to a blind end. The internal channel 60 is sized to accommodate a lifting/opening tab 20 of a pull-tab can. A cut-away section is included in the lower face of the elongated body. A groove 40 is provided in the lower face of the elongated body distally from the front end, so that the tool 10 may be locked onto the rim 55 of the container by snapping the upper edge of the rim into the groove 40. As understood from the disclosure and the drawings, the internal channel 60 of the tool 10 does not run along the entire length of the elongated body. In addition, it is clear from FIGS. 4 and 5 and the reference that, the tool sits on the lid of the container at an angle such that the frontal end sits on the top of the lid 51 while the groove 40 in the lower face of the distal snaps over the top of the rim 55 of the container. Since the tool is of uniform thickness, this configuration of the lid 51 and the elongated body leaves a triangular open space 5 along the underside of the elongated body. Although, the specification claims that the tool, along with the opening tab, "substantially" covers the opening of the can to restrict insects from entering, nonetheless, as clearly illustrated in FIG. 3, it fails to completely cover the opening of the can from all sides of the tool 10.

U.S. Pat. No. 5,509,380 to Tipp teaches a tab-lifting tool for lifting container lid tabs. The tool consists of a thin, relatively long, and narrow body suitable for holding in a user's thumb and fingers. The body has a front edge and top and bottom surfaces, the front edge having a beveled undersurface, which extends rearwardly and downwardly whereby the tool may be slipped under a container lid tab. The top surface has a generally planar main area and has a concave section intersecting the front edge having a sloped container lid tab-contacting surface that extends upwardly and rearwardly from the front edge until intersecting with the top surface. Again, since the bottom surface of the relatively long tool sits on the top of the rim of the container, it fails to completely close the opening of the can to prevent insects and foreign objects from entering the opening.

The aforementioned prior art devices, attempts to provide teachings to close an open beverage container, such that a complete seal of the opening is achieved. Though the search is not exhaustive, attempts to use a tool or device, in conjunction with an opening tab, in closing an open pull-tab container have not been successful. As described above, in all three references, although the device achieved some degree of success in covering an opening, nonetheless, all references fail to offer a device, which completely closed the opening under all circumstances to prevent access by insects or foreign matter. It is true that, though, an airtight seal is not required, yet the present problem calls for a solution, which requires the covering of an opening and restrict common insects and foreign materials from entering the opening. In addition, it is noted that, the prior art references all mention that their respective devices facilitate the opening of the can, but none of the references specifically teach how the device facilitates the opening of the can. Put it differently, none of the references describes the benefit of the composite characteristic, of the enclosed tab mounted inside the channel/locking arms, which can be obtained from a properly designed and configured extension sleeve disposed in conjunction with a pre-existing opening tab of a container.

Consequently, what is needed is a tab extending sleeve or tool, which can be used in conjunction with a pre-existing opening tab of a conventional container, first to effectively open the can, and subsequently covering the opening of the same ensuring against the entry of any foreign objects or insects.

BRIEF SUMMARY OF THE INVENTION

According to the present invention, there is provided a tab extending sleeve, which is intended to be used in conjunction with a ring-tab opening or a flip-top lid of a container. The tab extending sleeve is a longitudinal body having a length and a width constituting an area large enough to cover completely the opening to be made in the lid. The sleeve includes a top surface and a bottom surface. The sleeve also includes a frontal end and a distal end opposite the frontal end. The distal end includes a curvature, which conforms to the outer curvature of the rim of the container. The top surface extends upwardly from the frontal to the distal end having an extended holding lip disposed at the center of the distal end extending therefrom. The extended holding lip extends beyond the rim of the container so that the can is easily gripped to open the container. Further, the extended holding lip does not communicate in any way with the top of the rim of the container when the tab extending sleeve is moved to cover the opening of the container to insure that the extended holding lip extends over the rim. The top surface maybe beveled to accomplish this feature.

An internal channel is provided between the top surface and the planar bottom surface. The internal channel runs along the entire length of the tab extending sleeve from the frontal end to the distal end, such that the internal channel may be accessed from either the frontal or distal end. The internal channel is of uniform height, and extends completely through the tab extending sleeve from the frontal end through the distal end. The internal channel is sized such that most ring-tab or opening tabs of a flip-top container lid may be accommodated therein. At the frontal end, the bottom surface includes a central notch to nest against a rivet pin, which pivotally attached the ring-tab to the top lid of the flip-top upon mounting the tab extending sleeve to the ring-tab container at the approximate center of the lid. The central notch contacts the rivet pin while the portions on either side of the central notch of the frontal end of the tab extending sleeve and the top surface, engages the detent portion of the ring tab on the opposite side of the rivet to make firm contact therewith before lifting the tab extending sleeve using the extended holding lip for opening the can. Once inside the internal channel of the tab extending sleeve, the ring-tab forms a composite lever structure with the body of the tab extending sleeve. The detent portion of the ring-tab extends outside of the internal channel of the tab extending sleeve. When the tab is lifted by lifting the extended holding lip at the distal end of the tab extending sleeve, the detent portion of the ring-tab depresses a pre-scored flap portion in the lid, and pushes the flap inside the container to open the container. It is this composite lever effect of the ring-tab and the tab extending sleeve structure that makes certain that, the detent portion of the tab depresses the pre-scored flap to make an opening in the container. In the event the ring-tab is partially damaged prior to making an attempt to open the can, the frontal portion of the tab extending sleeve has sufficient overlap with the detent portions of the ring-tab to depress the pre-scored flap portion to open the container. Once open, the can opening can be covered by holding the extended lip and rotating the tab extending sleeve 180 degrees, to rotate the tab extending sleeve over the opening. Once positioned over the opening, the tab extending sleeve is pressed downwardly to snugly fit in a surface-to-surface relationship against the lid of the container with the tab extending sleeve in this position the extended holding slip does not communicate with the rim of the container. In opening the container, the detent portion of the ring-tab becomes deformed in a downward direction. Upon rotating the ring-tab to cover the opening with the tab extending sleeve, the deformed detent portion of the ring tab interferes with the remainder of the top lip and is forced to slide over the top surface of the lid. Because of this slight deformation, as well as, the fact that, the internal channel is at an acute angle with the horizontal plane, the distal end of the tab extending sleeve is forced in a downward direction resulting in a surface-to-surface contact between the bottom surface of the tab extending sleeve and the top surface of the lid. Therefore, when the ring-tab with the tab extending sleeve is rotated 180 degrees to cover the opening in the container, this surface-to-surface contact established therebetween completely covers the opening and insects or foreign matter cannot enter the opening. The distal end of the tab extending sleeve has a curvature which insures that the tab extending sleeve does not interfere with the inside diameter of the rim portion of the container.

Accordingly, it is an object of the present invention to offer a tab extending sleeve for opening a ring-tab or a flip-top container lid of a conventional beverage container or the like.

Another object of the present invention is to offer a tab extending sleeve, which provides a means for easy opening of a can for physically challenged people.

It is another object of the present invention to offer a tab extending sleeve, which provides a convenient means for opening a can without excessive effort or creating damage to fingers or fingernails.

A further object of the present invention is to offer a tab extending sleeve, which is capable of re-closing an open can in a surface to surface relationship to protect the contents from unwanted entry of foreign objects and insects.

It is yet another object of the present invention to offer a tab extending sleeve, which when mounted to a conventional ring-tab or flip-top container lid, creates a leverage composite structure to easily and comfortably open a flip-top container even for those physically challenged.

It is yet a further object of the present invention to offer a tab extending sleeve having an internal channel, which can be accessed from either end to retrieve a portion of a tab, in the event a portion of an opening tab is torn off or broken off and remains within the internal channel.

It is yet a further object of the invention to provide a tab extending sleeve tool, which is compact and easy to use on conventional flip-top containers without the need to amend the structure of the lid to accommodate the tool.

Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

A conventional beverage, snack, and pet food container tab extending sleeve for easy opening and covering of the opening will now be delineated in detail with reference to the accompanying drawings.

Figure 1:
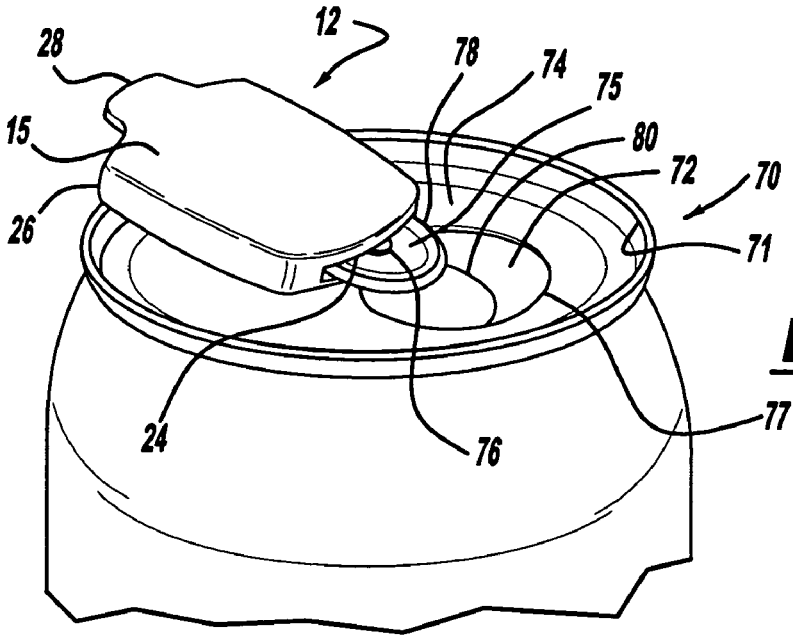
FIG. 1 is an exploded perspective view of the invention with the tab extending sleeve mounted on the ring-tab in position to partially open the container.
Figure 2:
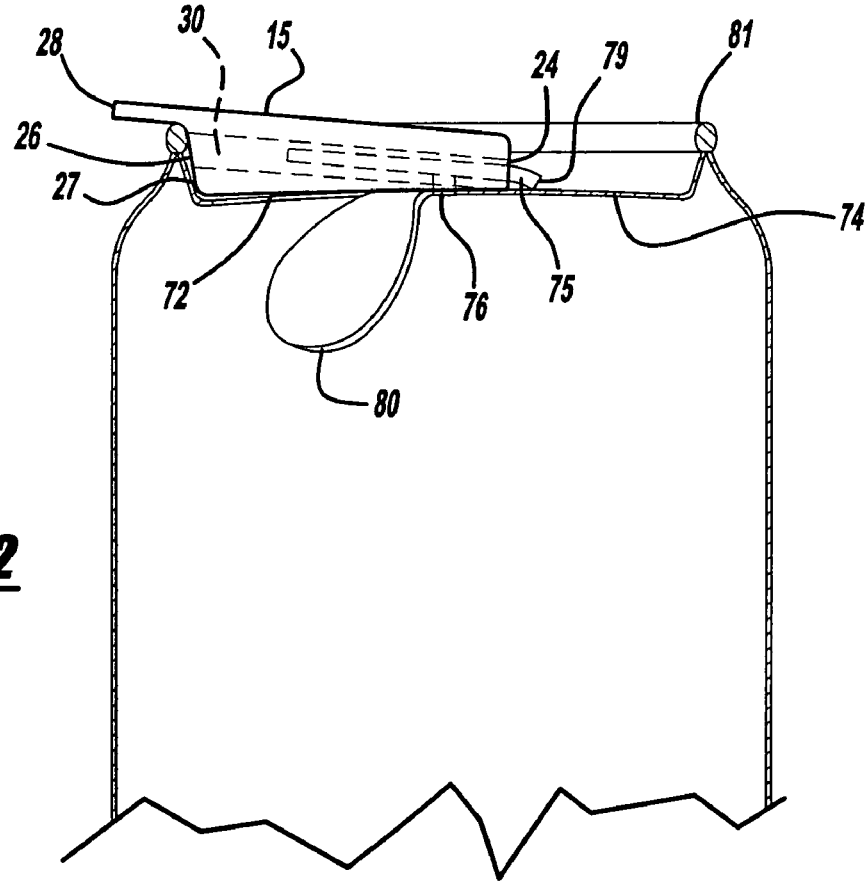
FIG. 2 is a cross-sectional view of a flip-top container, with the tab-extended sleeve rotated to cover the opening earlier made in the container.
Figure 3:
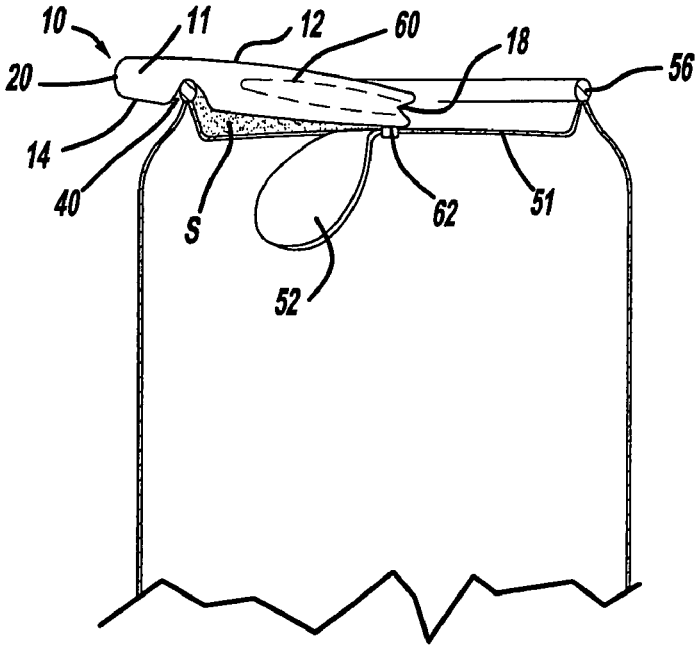
FIG - 3 Prior Art
FIG. 3 is a partial cross-sectional view of a prior art invention as described in U.S. Pat. No. 5,911,794 showing a triangular opening, which remains open even after the tool of the invention is locked/engaged with the rim of the container to cover the opening.
Figure 4:
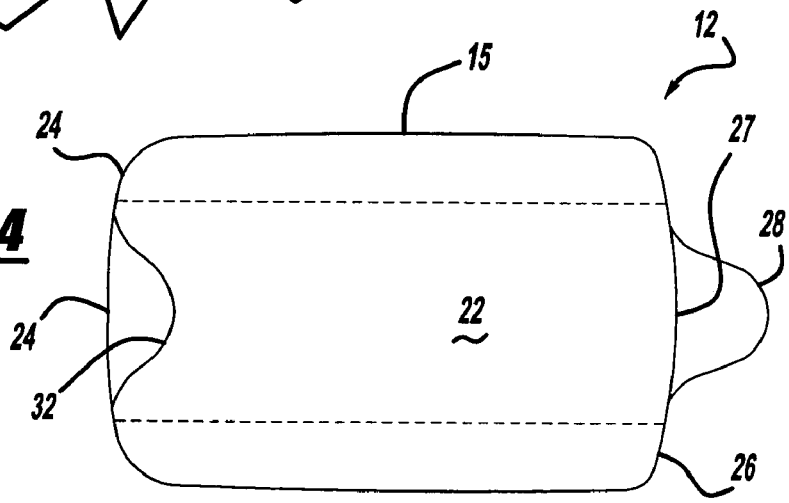
FIG. 4 is a bottom view of the planar bottom surface of the tab extending sleeve.
Figure 5:
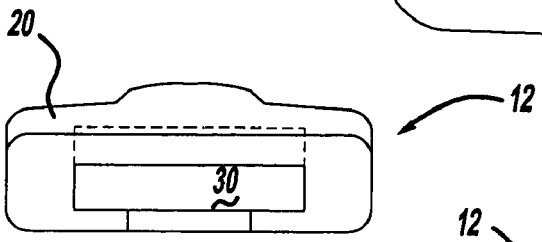
FIG. 5 is an end view of the tab extending sleeve.
Figure 6:
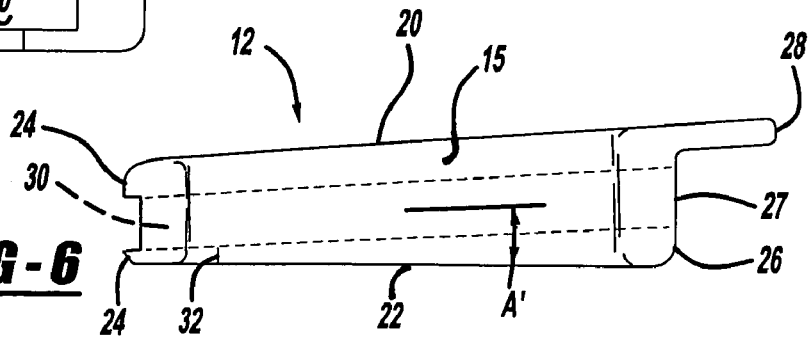
FIG. 6 is a side elevation view of the tab extending sleeve.

As illustrated in FIGS. 1, 2 and 4–6 there will now be described a tab extending sleeve 12 for use with a conventional flip-top or pull-tab container 70. The tab extending sleeve 12 is a longitudinal body 15 made of a durable material such as metal or suitable grade of plastic. The tab extending sleeve 12 has a length and a width constituting an area large enough to cover completely an opening 72 in a can lid 74. The tab extending sleeve 12 includes a top surface 20 which in the preferred embodiment is beveled to ensure that the extended holding lip 28 extends over the rim of the container without interfering therewith and a planar bottom surface 22. The sleeve also has a frontal end 24 and a distal end 26. The distal end 26 includes a curved end surface 27, which conforms to the outer curvature of the rim 71 of the can lid 74. The beveled top surface 20 extends upwardly from the frontal end 24 to the distal end 26 with the extended holding lip 28 disposed at the center of the distal end 26 and extending therebeyond without resting on the rim 71 of the container 70. An internal channel 30 is provided between the beveled top surface 20 and the planar bottom surface 22. The internal channel 30 runs along the entire length of the tab extending sleeve 12 from the frontal end 24 to the distal end 26, such that the internal channel 30 may be accessed from either the frontal end 24 or distal end 26 of the tab extending sleeve 12. The internal channel 30 is generally of uniform height, and generally substantially extends at an acute angle A with respect to the bottom surface 22 of the tab extending sleeve 12. The internal channel 30 is sized such that all prior art opening tabs 60 of flip-top container lids ring tabs (not shown) may be accommodated therein. At the frontal end 24, the bottom surface 22 includes a central notch 32 to accommodate a rivet post 76, which pivotally supports the opening tab 78 of the flip-top container 70 at the approximate center on the can lid 74. The notch 32 ensures that the rivet post 76 communicates with the central notch 32 and allows the frontal end 24 of the bottom surface 22 of the tab extending sleeve 12 on either side of the central notch 32, as well as, the frontal end 24 of the top surface 20 to extend well beyond the central notch 32 so as to communicate with the detent portion 75 of the pull tab that lies on the opposite side of the rivet post 76. When the tab extending sleeve 12 is slipped on the opening or ring-tab 78 of the flip-top container 70, it engages the same exerted force and is transferred through to the ring-tab detent portion 75 and onto the pre-scored opening flap 77 in the can lid 74 as the tab extending sleeve 12 is lifted to open the pull-tab container 70. Once the ring-tab 78 has completely entered the internal channel 30 of the tab extending sleeve 12, the tab extending sleeve 12 and the frontal end 24 of the opening tab 78 forms a composite lever structure along with the longitudinal body 15 of the tab extending sleeve 12. The detent portion 75 of the opening tab 78 extends beyond the frontal end 24 of the tab extending sleeve 12. This composite lever structure acts on the detent portion 75 of the ring-tab 78 to allow a user to easily lift the tab extending sleeve 12 such that the detent portion 75 of the opening tab 78 is forced against the pre-scored opening 77 in the top of the can lid 74 thereby allowing for easy opening of the ring top container 70.

When the ring-tab 78 is lifted by lifting the extended holding lip 28 at the distal end 26 of the tab extending sleeve 12, the detent portion 75 of the ring-tab 78 depresses a pre-scored flap 77 portion of the can lid 74, and pushes the flap 80 inside the container 70. It is this composite lever effect of the opening tab 78 in combination with the tab extending sleeve 12 that allows the detent portion 75 of the opening tab 78 to easily depress the pre-scored flap 80 to open the container 70. Once open, the opening in the container 70 may be covered by holding the extended lip 28 and rotating the tab extending sleeve 12 180 degrees so as to bring the tab extending sleeve 12 over the opening 72. Upon rotating the tab extending sleeve 12 mounted on the ring-tab 78 of the container 70 a surface to surface contact between the bottom surface 22 of the tab extending sleeve 12 and the lid of the can 74 is assured due to the following occurrences.

When the tab extending sleeve 12 is lifted to open the container 70, as noted above, the portions of the frontal end 24 of the tab extending sleeve 12 on either side of the central notch 32, as well as, the frontal end 24 of the top surface 20 communicate with the detent portion 75 of the ring-tab 78 on the opposing side of the rivet post 76 to bear down on the scored flap portion 77 of the can lid 74 to break open the can lid 74 and create the opening 72 for dispensing the liquid in the container 70. In so doing, the detent portion 75 of the ring-tab 78 is permanently deformed downwards 79 as a result of the opening activity. As the tab extending sleeve 12 mounted on the ring-tab 78 is rotated the detent portion 75 of the ring-tab 78 will come into direct contact with the can lid 74 of the container 70 and due to its earlier deformation 79 in the downward direction the detent portion 75 begins to climb upwards until it rests on the top of the can lid 74. As this climbing occurs the opposite end of the ring-tab 78 with the tab extending sleeve 12 thereon is forced downwards against the top surface of the can lid 74 and upon continued rotation the surface-to-surface contact between the bottom surface 22 of the tab extending sleeve 12 and the top surface of the can lid 74 is maintained so that once the tab extending sleeve 12 is rotated 180 degrees to cover the opening 72 in the can lid 74 of the container 70 there is no space between the bottom surface 22 of the tab extending sleeve 12 or the top surface of the can lid 74 for insects or foreign matter to pass through and gain access to the opening 72. This relationship of surface-to-surface contact is further enhanced by the acute angle A of the internal channel 30 with respect to the bottom surface 22 of the tab extending sleeve 12. Note that the internal channel 30 is at an acute angle A with the bottom surface 22 of the tab extending sleeve 12. Therefore, the aforementioned permanent downward deformation 79 of the detent portion 75 of the ring-tab 78 coming into contact with the non-deformed portion of the can lid 74 causes the detent portion 75 of the ring-tab 78 to begin to climb upwards onto the can lid 74 as the detent portion of the ring-tab 78 climbs up on the top of the lid 74, the distal end 26 of the tab extending sleeve 12 is biased downwards. The ring-tab 78 located within the internal channel 30 causes a reactionary downward force forcing the tab extending sleeve 12 into surface-to-surface contact with the can lid 74 surface so that the bottom surface 22 of the tab extending sleeve 12 is forced into contact with the top surface of the can lid 74. The acute angle A of the internal channel 30 allows this to occur without the extended holding lip 28 bottoming out on the top of the rim 81 of the container 70.

While the present invention has been described in terms of a preferred embodiment, it is apparent that other forms could be adopted by one skilled in the art. In other words, the teachings of the present invention encompass any reasonable substitutions or equivalents of claim limitations. For example, the structure, materials, sizes, and shapes of the individual components could be modified, or substituted with other similar structure, materials, sizes, and shapes. Those skilled in the art will appreciate that other applications, including those outside of the beverage industry, are possible with this invention. Accordingly, the present invention is not limited to only beverage containers. Accordingly, the scope of the present invention is to be limited only by the following claims.

What is claimed is:

1. A tab extending sleeve having a frontal end at one end and a distal end at an opposite end adapted for mounting on a ring-tab attached with a rivet to the top lid of a beverage container for easy opening and covering an opening in a pre-scored lid of a beverage container, said tab-extending sleeve comprising:

an elongated body member having a frontal end;

a distal end opposite said frontal end;

a bottom surface extending from said frontal end to said distal end, said frontal end of said bottom surface having a notch centrally disposed therein;

a top surface spaced a predetermined distance from said bottom surface, said top surface extending from said frontal end to said distal end, said distal end of said top surface having an extended lip portion extending in a direction opposite to said central notch in said bottom surface and overlaying a peripheral rim edge of said beverage container, said frontal end of said top surface extending over said centrally disposed notch;

an internal channel located between said bottom surface and said top surface, said internal channel extending from said frontal end through said distal end of said elongated body, said internal channel being oriented in said elongated body member at an acute angle with respect to said bottom surface such that the lowest portion of said internal channel is at said frontal end of said elongated body and inclines upwards at said acute angle as said internal channel extends through said elongated body towards said distal end, whereby said internal channel is sized at least as high and at least as wide as the ring-tab of said beverage container, such that when said tab extending sleeve is mounted on said ring-tab of said top lid of said beverage container, said extended lip portion extends over said rim of said lip to enable a user to lift said extended lip portion and thereby open said pre-scored lid of said beverage container.

2. The tab extending sleeve as claimed in claim 1, wherein said internal channel extends along the entire length of said tab extending sleeve.

3. The tab extending sleeve as claimed in claim 1, wherein height of said channel is uniform.

4. The tab extending sleeve as claimed in claim 1, wherein width of said channel is uniform.

5. The tab extending sleeve as claimed in claim 1 wherein said top surface is substantially parallel to said internal channel, whereby said extended lip portion of said top surface extends over said outer rim of said beverage container when said bottom surface is in a surface-to-surface contact with said surface of said top lid of said beverage container.

6. The tab extending sleeve as claimed in claim 1 wherein said frontal end of said top surface extends substantially forward of said notch in said bottom surface of said tab extending sleeve such that said frontal end of said top surface deforms a detent portion of said ring-tab to open said pre-scored lid of said beverage container.

7. The tab extending sleeve as claimed in claim 1, wherein said channel is disposed at an acute angle with respect to said bottom surface of said tab extending sleeve.

8. The tab extending sleeve as claimed in claim 1, wherein said internal channel is accessible from both said frontal and said distal ends of said tab extending sleeve.

9. The tab extending sleeve as claimed in claim 1, wherein said notch of said bottom surface is configured to accommodate a pivotally attached rivet pin, which attaches said ring-tab to said lid of said lift-top container, whereby when said tab extending sleeve is slipped onto said ring-tab, said rivet pin is located inside said notch and said frontal end of said upper surface extends therebeyond.

10. The tab extending sleeve as claimed in claim 1 wherein said distal end of said tab extending sleeve is arcuate.

11. The tab extending sleeve as claimed in claim 1 wherein said distal end is circular.

* * * * *